US010137466B2

(12) United States Patent
Bruder et al.

(10) Patent No.: US 10,137,466 B2
(45) Date of Patent: Nov. 27, 2018

(54) DISCHARGE HEAD

(71) Applicant: APTAR RADOLFZELL GMBH, Radolfzell (DE)

(72) Inventors: Thomas Bruder, Constance (DE); Tobias Baumann, Gottmadingen-Randegg (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 0 days.

(21) Appl. No.: 15/541,585

(22) PCT Filed: Dec. 14, 2015

(86) PCT No.: PCT/EP2015/079667
§ 371 (c)(1),
(2) Date: Jul. 5, 2017

(87) PCT Pub. No.: WO2016/119970
PCT Pub. Date: Aug. 4, 2016

(65) Prior Publication Data

US 2017/0341095 A1 Nov. 30, 2017

(30) Foreign Application Priority Data

Jan. 29, 2015 (EP) ..... 15153091

(51) Int. Cl.
*B05B 11/00* (2006.01)
*B65D 47/20* (2006.01)

(52) U.S. Cl.
CPC ..... *B05B 11/0062* (2013.01); *B65D 47/2068* (2013.01)

(58) Field of Classification Search
CPC ..... B05B 11/0062; B65D 47/2068
(Continued)

(56) References Cited

U.S. PATENT DOCUMENTS 6,386,404 B1 * 5/2002 Auer ..... B65D 35/20 222/212
6,938,800 B1 * 9/2005 Lehmkuhl ..... B05B 11/047 222/153.14
(Continued)

FOREIGN PATENT DOCUMENTS

FR 996343 12/1951
WO WO 2012/059691 A1 5/2012

OTHER PUBLICATIONS

International Search Report issued in Application No. PCT/EP2015/079667 with English translation dated Feb. 26, 2016 (5 pages).
(Continued)

*Primary Examiner* — Lien Ngo
(74) *Attorney, Agent, or Firm* — Flynn Thiel, P.C.

(57) ABSTRACT

A discharge head for a dispenser including a securing element coupling the discharge head to the dispenser, a housing having an outlet opening, and a valve body. The valve body closes the outlet opening when the pressure of a medium in the discharge head is below a threshold value, and in a ready-for-use state the valve body releases the outlet opening when the pressure of the medium in the discharge head is above the threshold value. The valve body is mounted over a travel path for releasing and closing the outlet opening, and a locking handle moves in relation to the securing element in order to transfer the discharge head into a locked state in which the travel path of the valve body is reduced to zero, and/or in order to transfer the discharge head from the locked state into the ready-for-use state.

15 Claims, 3 Drawing Sheets

(58) Field of Classification Search
USPC ..... 222/153.14, 491–497, 206–209, 212, 222/511–514, 518
See application file for complete search history.

(56) References Cited

U.S. PATENT DOCUMENTS

| | | | | |
|---|---|---|---|---|
| 6,974,053 | B2 * | 12/2005 | Lautre | B65D 47/2081 222/212 |
| 7,721,918 | B1 * | 5/2010 | Lehmkuhl | B05B 11/047 222/153.14 |
| 8,534,509 | B2 | 9/2013 | Duquet | |
| 9,085,409 | B2 * | 7/2015 | Brall | B65D 35/46 |
| 2011/0121037 | A1 | 5/2011 | Kakuta | |
| 2012/0080449 | A1 | 4/2012 | Lehmkuhl et al. | |
| 2012/0111900 | A1 | 5/2012 | Duquet | |

OTHER PUBLICATIONS

Written Opinion of the International Searching Authority issued in Application No. PCT/EP2015/079667 dated Feb. 26, 2016 (5 pages).
Search Report of European Patent Office issued in Application No. 15153091 with English translation of category of cited documents dated Jul. 8, 2015 (3 pages).

* cited by examiner

DISCHARGE HEAD

FIELD OF USE AND PRIOR ART

The invention relates to a discharge head, in particular a discharge head for a tube. The invention further relates to a dispenser with a deformable wall and with a discharge head.

Tube dispensers, or tubes for short, are generally known in particular for receiving and for discharging pasty or paste-like media such as toothpaste, cream, glue or paints. Known tubes usually have an outlet nozzle which is in most cases provided with an outer thread and which has a considerably reduced diameter compared to the external diameter of the tube. In the simplest form, a closure cap is fitted onto the outlet nozzle, in particular screwed onto it, and is taken off prior to use and put back on after use. In addition, simple discharge heads with an outlet opening are known which are fitted onto the outlet nozzle and on which a pivotably movable protective cap is provided which, during periods of non-use, is latched in a position closing the outlet opening of the discharge head.

WO 2012/059691 A1 discloses a discharge head for tubes, in which discharge head a pressure-controlled outlet valve is provided which automatically opens when pressure is applied to the medium in the tube and when the pressure in the discharge head thereby increases, and automatically closes when this application of pressure ceases. For this purpose, the discharge head comprises an outlet opening, and a valve body which is displaceable relative to the latter and which is formed on an element made of an elastic material that is deformable when pressure is applied so as to displace the valve body.

Problem and Solution

A problem addressed by the invention is to make available a discharge head in which a discharge of a medium as a result of inadvertent actuation is safely avoided. A further problem is to make available an associated dispenser with a discharge head.

According to a first aspect, a discharge head for a dispenser is made available, comprising a securing element for coupling the discharge head to the dispenser, a housing having an outlet opening, and a valve body, wherein the valve body closes the outlet opening when the pressure of a medium in the discharge head is below a threshold value, and, in the ready-for-use state, the valve body releases the outlet opening when the pressure of the medium in the discharge head is above the threshold value, wherein the valve body, in the ready-for-use state, is displaceable along an adjustment path for releasing and closing the outlet opening, and wherein a locking handle is provided which is movable relative to the securing element, in order to transfer the discharge head to a locked state in which the adjustment path of the valve body is reduced to zero, and/or in order to transfer the discharge head from the locked state to the ready-for-use state.

In the locked state, a movement of the valve body is prevented through elimination of its adjustment path. Therefore, inadvertent application of pressure to a dispenser having a corresponding discharge head does not cause medium to be discharged. Transfer of the discharge head to the ready-for-use state and from the ready-for-use state to the locked state is preferably repeatedly possible. However, embodiments are also conceivable in which a dispenser is supplied with the discharge head in the locked state and, at the time of first use, the discharge head is transferred permanently to the ready-for-use state.

In advantageous embodiments, the valve body is kinematically decoupled from the locking handle, such that a movement of the locking handle relative to the securing element is not transmitted to the valve body. During an actuation of the locking handle in a closure position of the valve body at the outlet opening, this prevents a situation where unlocking at the same time causes a discharge of a medium and/or where relative movements between the valve body and the outlet opening are caused that have a destructive effect on the valve body.

According to the invention, the housing is coupled to the securing element so as to be fixed in rotation and movable in the direction of the adjustment path, wherein the adjustment path of the valve body is dependent on a distance between the housing and the securing element. By means of suitable elements, the valve body is mounted so as to be displaceable along the adjustment path between the housing and the securing element.

In advantageous embodiments, the locking handle is mounted on the securing element in such a way as to be rotatable about an axis extending parallel to the adjustment path, preferably about the longitudinal axis of the discharge head. In a development of the invention, the housing is kinematically coupled to the locking handle, wherein a twisting of the locking handle relative to the securing element causes a movement of the housing relative to the securing element in the direction of the adjustment path. When as associated dispenser is grasped, a locking handle of this kind can be actuated ergonomically with one hand, for example by means of the thumb of one hand. Moreover, forces resulting from an application of pressure do not act directly in the actuation direction of the locking handle, such that the danger of inadvertent transfer from the locked position to the ready-for-use position, or vice versa, is small.

To permit the kinematic coupling, the housing in one embodiment has a first sleeve-shaped connecting portion, and the locking handle has a second sleeve-shaped connecting portion which is arranged rotatably in or on the first sleeve-shaped connecting portion, wherein mutually facing jacket surfaces have at least one control curve and a control cam interacting with the latter. A suitable movement profile is thus obtainable through the configuration of the control curve. For easier production without visible coupling elements, the at least one control curve is preferably provided on an outer jacket surface of the connecting portion of the locking handle, wherein the housing is fitted onto this connecting portion.

The valve body is arranged so as to be displaceable along the adjustment path between the housing and the securing element. In advantageous embodiments, the valve body is formed on a bearing element and, by means of this bearing element, is mounted movably between the housing and the securing element along the adjustment path.

In advantageous embodiments, the bearing element has a compensating element, by means of which the valve body is mounted movably between the housing and the securing element along the adjustment path. In other words, the adjustment path is realized through a mobility of the compensating element.

Moreover, the bearing element preferably has a sleeve which can be mounted in a fixed position on the securing element, wherein the valve body is coupled movably to the sleeve along the adjustment path by means of the compensating element. To provide a good sealing action, the valve body is preferably made of a soft and/or elastic material.

Thermoplastic elastomers (TPE) are particularly suitable. By contrast, the sleeve is preferably made of a material with a high degree of dimensional stability, for example of polypropylene or HDPE (high density polyethylene). In one embodiment, the individual elements of the bearing element are produced separately and then connected to one another, for example welded or adhesively bonded. In advantageous embodiments, the bearing element is produced as a multi-component injection molding. This permits cost-effective production without additional assembly steps.

In one embodiment, the valve body is designed in such a way that it also functions as a piston. In advantageous embodiments, the bearing element has a piston that takes up forces for an adjustment movement of the valve body, which piston is preferably made of a material with greater stiffness than the material of the valve body.

In one embodiment, the valve body is fastened in the discharge head exclusively by means of the sleeve. In advantageous embodiments, the bearing element moreover has a securing ring secured on the housing, which securing ring is spaced apart from the sleeve in the direction of the adjustment path and is arranged coaxially with respect to the sleeve.

For applying pressure to the piston to open the outlet opening, the housing preferably has a pressure chamber adjacent to the outlet opening.

In one embodiment, the compensating element of the bearing element functions as a resetting element which forces the valve body to the closure position. However, in advantageous embodiments, a separate resetting element is provided which forces the valve body to the closure position.

According to a second aspect, a dispenser with a deformable wall and with a discharge head is made available, wherein the discharge head comprises a securing element for coupling the discharge head to the dispenser, a housing having an outlet opening, and a valve body, wherein the valve body closes the outlet opening when the pressure of a medium in the discharge head is below a threshold value, and, in the ready-for-use state, the valve body releases the outlet opening when the pressure of the medium in the discharge head is above the threshold value, wherein the valve body, in the ready-for-use state, is displaceable along an adjustment path for releasing and closing the outlet opening, and wherein a locking handle is provided which is movable relative to the securing element, in order to transfer the discharge head to a locked state in which the adjustment path of the valve body is reduced to zero, and/or in order to transfer the discharge head from the locked state to the ready-for-use state.

The dispenser has a deformable wall, wherein deformation of the wall allows pressure to be applied to the medium and allows the medium to be conveyed to the discharge head. The dispenser is preferably a tube. However, a design as a squeeze bottle or the like is also conceivable.

For easy handling, the securing element of the discharge head, in advantageous embodiments, is mounted in a rotationally fixed manner on the dispenser.

In a ready-for-use state, the outlet opening and the valve body form a pressure-controlled outlet valve which opens when pressure is applied to the medium in the dispenser, and which closes when this application of pressure ceases.

BRIEF DESCRIPTION OF THE DRAWINGS

Further aspects and advantages of the invention will be gathered not just from the claims, but also from the following description of a preferred illustrative embodiment of the invention, which is explained below with reference to the figures, in which:

DETAILED DESCRIPTION OF THE ILLUSTRATIVE EMBODIMENT

Figure 1:
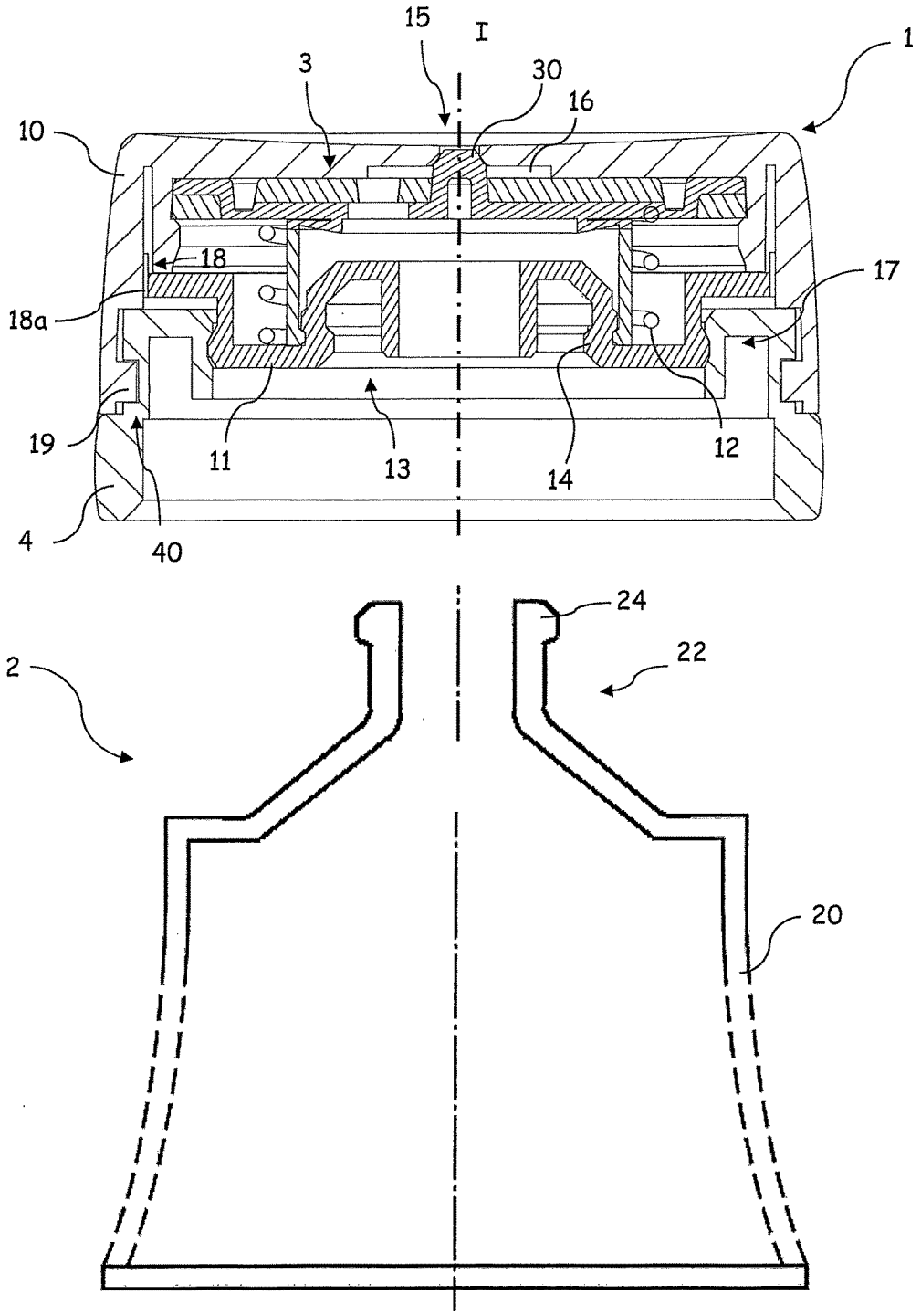
FIG. 1 shows a tube and a discharge head according to the invention in an as yet unassembled state.
Figure 2:
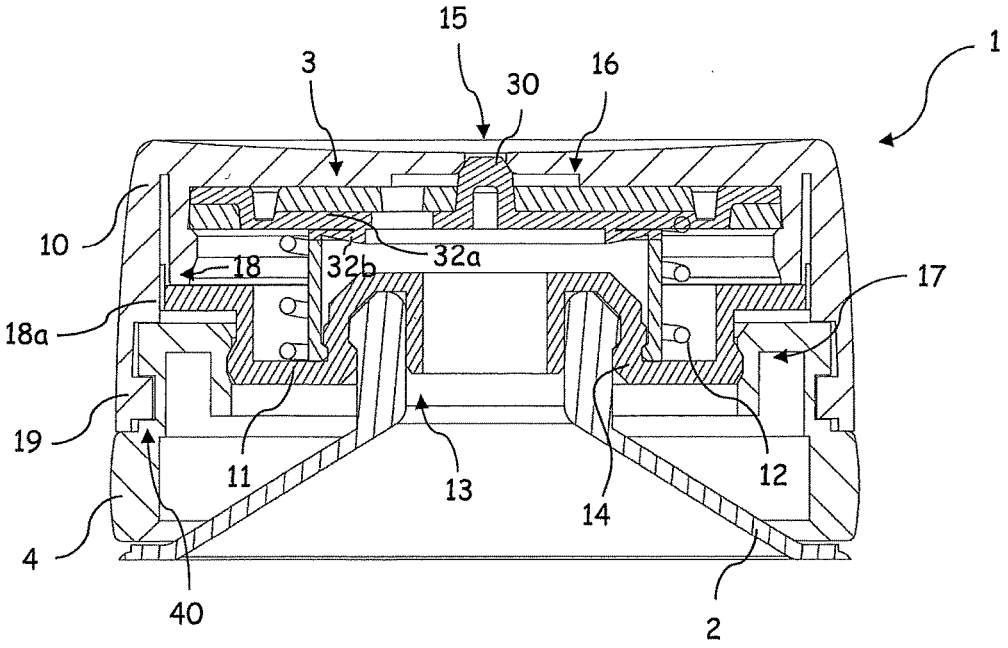
FIG. 2 shows a discharge head as per FIG. 1 in a locked state after being fitted on a tube.
Figure 3:
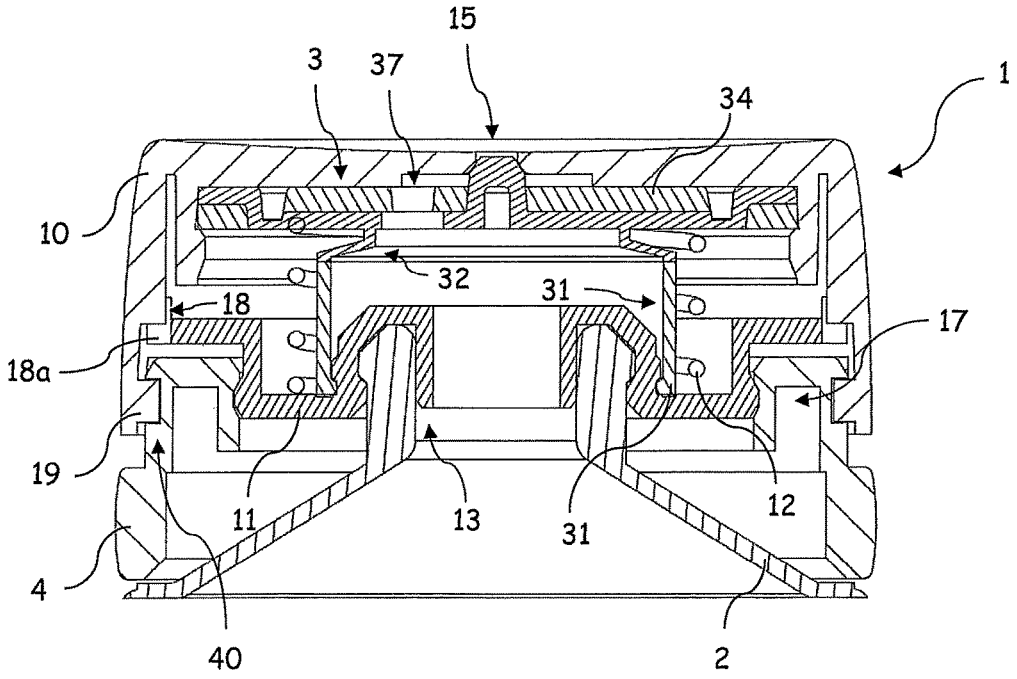
FIG. 3 shows the discharge head as per FIG. 2 in a ready-for-use state after assembly.

FIG. 1 shows a schematic cross-sectional view of a discharge head 1 and a tube 2 in an as yet unassembled state. FIGS. 2 and 3 are schematic cross-sectional views showing the discharge head 1 from FIG. 1 after assembly on a tube 2, in a locked state and in a ready-for-use state, respectively.

The discharge head 1 comprises a housing 10, a securing element 11, a resetting element 12, a bearing element 3 and a locking handle 4. The resetting element 12 shown is designed as a spring element, more precisely as a helical spring. However, other configurations are also conceivable.

The tube 2 has a tube body 20 for receiving a pasty medium, and an outlet nozzle 22 for coupling to the discharge head 1.

The securing element 11 has an annular cap-shaped securing structure, by which a receiving well 13 for the outlet nozzle 22 is formed. To assemble the discharge head 1 on the tube 2, the outlet nozzle 22 is guided into the receiving well 13 in the direction of the longitudinal axis I. The outlet nozzle 22 and the securing element 11 have coupling elements 24, 14 complementing each other, by means of which the discharge head 1, depending on its design, can be secured on the tube 2 either permanently or in such a way as to be removable without destruction. In the illustrative embodiment shown, the coupling elements 14, 24 are designed as latch grooves and latching lugs for a latched connection. This permits straightforward assembly. In other embodiments, threads are provided for coupling. It is obvious to a person skilled in the art that, instead of a tube 2, another dispenser with an outlet nozzle 22 can also be connected to the discharge head 1. The securing element 11 is preferably connected to the tube 2 in a rotationally fixed manner.

The housing 10 has an outlet opening 15 which, in a closure position (shown in all of FIGS. 1 to 3), is closed off by a valve body 30 arranged on the bearing element 3. A pressure space 16 is provided on a side of the outlet opening 15 directed away from the exterior. The resetting element 12 forces the valve body 30 to the closure position shown in FIGS. 1 to 3. In this position, the valve body 30 bears sealingly on the housing 10.

In the illustrative embodiment shown, the locking handle 4 is connected to the securing element 11 in such a way as to be axially fixed and to be rotatable about the longitudinal axis I. For this purpose, the securing element 11 and the locking handle 4 have suitable coupling elements 17.

A rotation movement of the housing 10 relative to the securing element 11 about the longitudinal axis I is prevented by means of blocking elements 18. In the illustrative embodiment shown, the securing element 11 for this purpose has guide teeth 18*a*, which engage in associated guide contours on the housing 10.

By means of a movement of the locking handle 4 relative to the securing element 11, the discharge head 1 can be transferred from the locked state shown in FIGS. 1 and 2 to the ready-for-use state shown in FIG. 3. The movement of the locking handle 4 relative to the securing element 11 is for this purpose converted into a movement of the housing 10 relative to the securing element 11 in the direction of the longitudinal axis I.

In the illustrative embodiment shown, the discharge head 1 can be transferred from the locked state shown in FIGS. 1 and 2 to the ready-for-use state shown in FIG. 3 by a rotation movement of the locking handle 4 relative to the securing element 11 about the longitudinal axis I. The rotation movement of the locking handle 4 relative to the securing element 11, and thus relative to the housing 10 coupled in a rotationally fixed manner to the securing element 11, is for this purpose converted into a movement of the housing 10 in the direction of the longitudinal axis I by means of at least one control curve 40 of the locking handle 4 and an associated control cam 19 on the housing 10.

Figure 4:
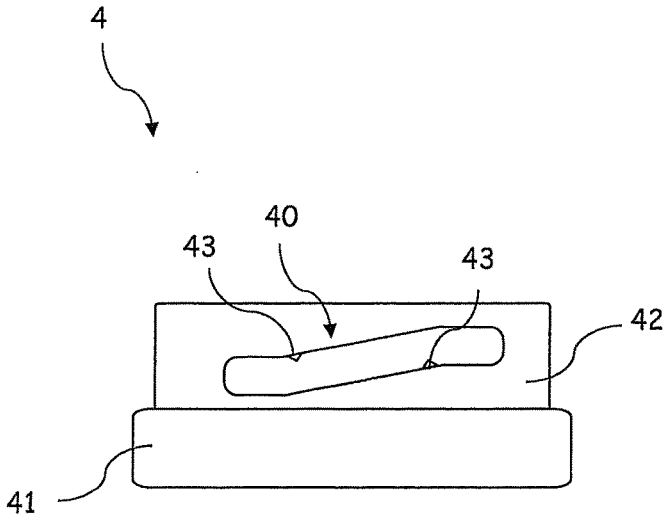
FIG. 4 shows a locking handle for the discharge head as per FIGS. 1 to 3.

FIG. 4 shows a schematic side view of a locking handle 4. The locking handle 4 comprises a grip area 41, at which a movement can be initiated by a user. The grip area 41 preferably has a suitable surface structure in order to ensure ergonomic handling and a user-friendly touch. For example, the grip area 41 has a knurled or fluted surface in order to increase frictional forces during initiation of the movement. The locking handle 4 moreover has a sleeve-shaped connecting portion 42 on which at least one groove is provided, preferably several grooves distributed about the circumference, which grooves form the control curves 40. In the illustrative embodiment shown in FIG. 4, a control curve 40 is provided which, at each of its ends, has a portion extending without gradient in the circumferential direction, and, between these, it has a portion of constant gradient extending helically on the sleeve-shaped connecting portion 42. Two latch elements 43 are provided on the control curve 40, wherein a greater force has to be applied to overcome these latch elements 43. By means of the latch elements 43, the control cam 19 of the housing 10 is secured in an extreme position. On account of the gradient-free portions provided at the ends, a movement initiated on the locking handle 4 from an extreme position does not initially cause any movement of the housing. This is advantageous for avoiding inadvertent actuation.

It is obvious to a person skilled in the art that a movement profile of the housing 10 relative to the securing element 11 in the direction of the longitudinal axis I, via the rotation movement of the locking handle 4 relative to the securing element 11, is modifiable through the configuration of the control curve 40. A person skilled in the art will accordingly choose an optimized contour of the control curve 40 depending on the specific use.

In the locked state of the discharge head 1 as shown in FIGS. 1 and 2, no actuation for discharge is possible. It is only when it is unlocked, by movement of the locking handle 4 relative to the securing element 11, that the discharge head is transferred to the ready-for-use state shown in FIG. 3, in which the valve body 30 is displaceable relative to the outlet opening 15.

The valve body 30 is mounted adjustably between the housing 10 and the securing element 11 by means of the bearing element 3.

Figure 5:
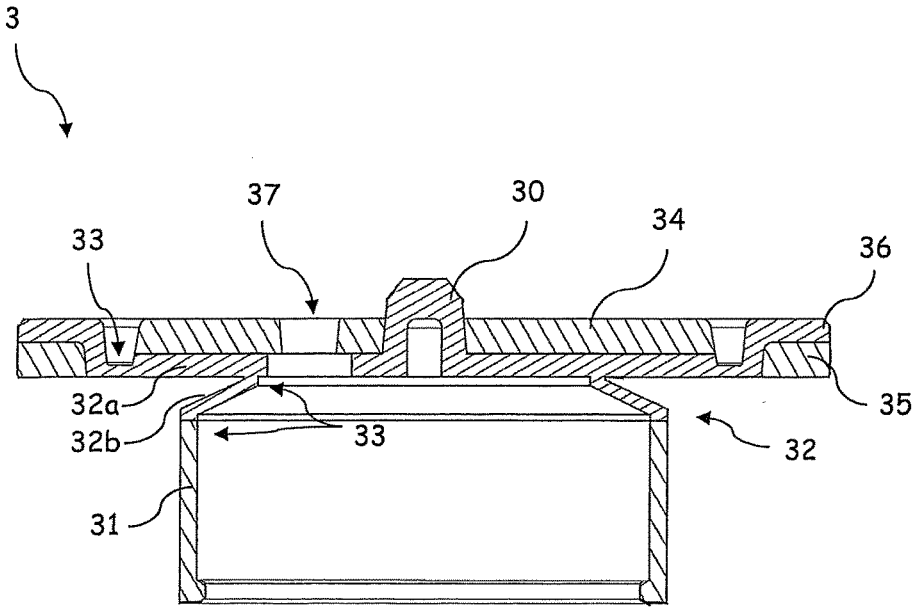
FIG. 5 shows a bearing element for a discharge head as per FIGS. 1 to 3.

As is shown in detail in FIG. 5, the bearing element 3 comprises a sleeve 31 and a compensating element 32, wherein the valve body 30 is mounted movably relative to the sleeve 31 by means of the compensating element 32.

An outer jacket surface of the sleeve 31 serves as a support surface for the resetting element 12 as per FIGS. 1 to 3. The sleeve 31 is arranged coaxially with respect to the outlet nozzle 22 of the tube 2. In the illustrative embodiment shown, the securing element 11 (cf. FIGS. 1 to 3) has an annular cap-like securing structure, wherein the sleeve 31 is arranged on an outer jacket surface of this securing structure 11 and is locked onto the securing structure.

The sleeve 31 is made from a material having a high degree of stiffness, wherein the stiffness is chosen such that, when pressure is applied to move the valve body 30, there is no deformation, or at any rate no relevant deformation, of the sleeve 31. The valve body 30 is movable relative to the sleeve 31 when pressure is applied. For this purpose, the bearing element 3 has a compensating element 32 by means of which the valve body 30 is coupled to the sleeve 31. In the illustrative embodiment shown, the compensating element 32 is formed by two arms 32*a*, 32*b* which are arranged in a V shape and which are coupled pivotably to each other and at the two ends by means of flexure bearings 33. The arms 32*a*, 32*b* are each designed as annular elements. In other embodiments, a bellows formation can be provided between valve body 30 and sleeve 31 in order to achieve a longer adjustment path. In yet other embodiments, a sleeve that is elastically deformable in the radial direction is provided as compensating element.

The bearing element 3 moreover comprises a piston 34, at which the bearing element 3 is subjected to pressure by the medium during use. The piston 34 also serves as an engagement surface for the resetting element 12 (cf. FIGS. 1 to 3). A reliable introduction of force is achieved by the piston 34.

In the illustrative embodiment shown, a securing ring 35 is provided on an outer circumference of the bearing element 3 in contact with the housing 10, which securing ring 35 serves for securing, for example latching, on the housing 10. A sealing ring 36 is provided for sealing with respect to the housing 10. In one embodiment, the securing ring 35 and the housing 10 are designed in such a way that a rotation movement of the securing ring 35 relative to the housing 10 about the longitudinal axis I is prevented.

The sealing location formed on the sealing ring 36 and the sealing location formed on the valve body 30 thus contribute to sealing off an interior of the discharge head 1 and of the tube 2 from the environment.

The bearing element 3 shown is a one-piece component, which is produced by means of two-component injection molding. Such a component is also designated in the context of the application as a two-component injection molding.

In the illustrative embodiment shown, the valve body 30, the compensating element 32 and the sealing ring 36 are produced from a first material and form an uninterrupted structure. The first material is an elastically deformable material. The elastic properties can advantageously be exploited both for a sealing action at the outlet opening 15 and with respect to the housing 10 (cf. FIG. 1) and also for a repeated movement of the compensating element 32. The sleeve 31, the piston 34 and the securing ring 35 are produced from a second material, which has a greater stiffness than the first material. The sleeve 31, the piston 34 and the securing ring 35 do not form a common structure and are interconnected via the structure produced from the first material. In the illustrative embodiment shown, the piston 34 is arranged on a side of the structure that faces toward the outlet opening 15 during use. In other illustrative embodiments, the piston 34 is arranged on the opposite side of the structure. For improved stability, the securing ring 35 is arranged on the structure made from the first material on a side thereof lying opposite the piston 34. In the illustrative embodiment shown, an arm 32*a* of the compensating element 32 bears permanently on a side of the piston 34 directed away from the pressure chamber 16. The resetting element 12 engages on the arm 32*a* and thus on the piston 34.

The bearing element 3 has a through-opening 37 for the medium, said through-opening 37 being offset radially from the centrally arranged valve body 30.

Independently of the design of the discharge head, the design of the bearing element 3 is also particularly advantageous for other uses.

For an application in the ready-for-use state according to FIG. 3, a medium is conveyed out of the tube 2, by permanent or intermittent deformation of the tube body 20, through the outlet nozzle 22 and the through-opening 37 of the bearing element 3 into the pressure space 16 in the direction of the outlet opening 15. This leads to pressure being applied to the bearing element 3 on a surface that faces toward the pressure space 16 and that has the piston 34. When sufficient pressure is applied, the piston 34 and the valve body 30 surrounded by the piston 34 are moved relative to the sleeve 31 out from the closure position counter to the force of the resetting element 12, such that the valve body 30 releases the outlet opening 15. When the application of pressure ceases, the resetting element 12 forces the piston 34 and the valve body 30 back to the closure position shown in FIG. 3.

After an application, the discharge head 1 can be transferred back to the locked state shown in FIGS. 1 and 2 by actuation of the locking handle 4.

By changing the distance between the housing 10 and the securing element 11, a maximum adjustment path of the valve body 30 can be set upon an actuation of the locking handle 4. If a distance between the housing 10 and the securing element 11 is reduced in such a way that the arms 32*a*, 32*b* of the compensating element 32 abut each other (cf. FIG. 2), a movement of the valve body 30 is prevented. Thus, no release of the outlet opening 15 by movement of the valve body 30 is possible when pressure is applied.

In the illustrative embodiment shown, the shape of the control curve 40 (cf. FIG. 4) determines that an application of pressure of any extent does not bring about a destruction-free movement to the ready-for-use state and a then possible actuation. In a modified embodiment, the control curve is configured in such a way that automatic unlocking is possible when a threshold value is exceeded, in order thereby to prevent damage to the dispenser as a whole.

The housing 10 and the securing element 11 are connected to each other so as to be movable relative to each other to a limited extent in the direction of the longitudinal axis I. The further elements of the discharge head 1 are accommodated between the housing 10 and the securing element 11, such that a pre-assembled structure is created.

The invention claimed is:

1. A discharge head for a dispenser, comprising a securing element for coupling the discharge head to the dispenser, a housing having an outlet opening and a valve body, wherein the valve body closes the outlet opening when the pressure of a medium in the discharge head is below a threshold value, and, in a ready-for-use state, the valve body releases the outlet opening when the pressure of the medium in the discharge head is above the threshold value, and wherein the valve body, in the ready-for-use state, is displaceable along an adjustment path for releasing and closing the outlet opening, wherein a locking handle is provided which is movable relative to the securing element, in order to transfer the discharge head to a locked state in which the adjustment path of the valve body is reduced to zero, and/or in order to transfer the discharge head from the locked state to the ready-for-use state, and the housing is coupled to the securing element so as to be rotationally fixed and movable in the direction of the adjustment path, wherein the adjustment path of the valve body is dependent on a distance between the housing and the securing element.

2. The discharge head as claimed in claim 1, wherein the valve body is kinematically decoupled from the locking handle, such that a movement of the locking handle relative to the securing element is not transmitted to the valve body.

3. The discharge head as claimed in claim 1, wherein the locking handle is mounted on the securing element in such a way as to be rotatable about an axis extending parallel to the adjustment path.

4. The discharge head as claimed in claim 3, wherein the housing is kinematically coupled to the locking handle, wherein a twisting of the locking handle relative to the securing element causes a movement of the housing relative to the securing element in the direction of the adjustment path.

5. The discharge head as claimed in claim 4, wherein the housing has a first sleeve-shaped connecting portion, and the locking handle has a second sleeve-shaped connecting portion which is arranged rotatably in or on the first sleeve-shaped connecting portion, wherein the first sleeve-shaped connecting portion and the second sleeve-shaped connecting portion have mutually facing surfaces, one of the surfaces including at least one control curve and the other of the surfaces including a control cam interacting with the control curve.

6. The discharge head as claimed in claim 1, wherein the valve body is arranged on a bearing element and, via the bearing element, is mounted movably between the housing and the securing element along the adjustment path.

7. The discharge head as claimed in claim 6, wherein the bearing element has a compensating element, via which the valve body is mounted movably between the housing and the securing element along the adjustment path.

8. The discharge head as claimed in claim 7, wherein the bearing element has a sleeve which can be mounted in a fixed position on the securing element, wherein the valve body is coupled movably to the sleeve along the adjustment path via the compensating element.

9. The discharge head as claimed in claim 6, wherein the bearing element has a piston that takes up forces for an adjustment movement of the valve body.

10. The discharge head as claimed in claim 8, wherein the bearing element has a securing ring secured on the housing, which securing ring is spaced apart from the sleeve in the direction of the adjustment path and is arranged coaxially with respect to the sleeve.

11. The discharge head as claimed in claim 1, wherein the housing has a pressure chamber adjacent to the outlet opening.

12. The discharge head as claimed in claim 1, wherein a resetting element is provided which forces the valve body to the closure position.

13. A dispenser with a deformable wall and with a discharge head, comprising a securing element for coupling the discharge head to the dispenser, a housing having an outlet opening and a valve body, wherein the valve body closes the outlet opening when the pressure of a medium in the discharge head is below a threshold value, and, in a ready-for-use state, the valve body releases the outlet opening when the pressure of the medium in the discharge head is above the threshold value, wherein the valve body, in the ready-for-use state, is displaceable along an adjustment path for releasing and closing the outlet opening, and wherein a locking handle is provided which is movable relative to the securing element, in order to transfer the discharge head to a locked state in which the adjustment path of the valve body is reduced to zero, and/or in order to transfer the discharge head from the locked state to the ready-for-use state, and the housing is coupled to the securing element so as to be rotationally fixed and movable in the direction of the adjustment path, the adjustment path of the valve body being dependent on a distance between the housing and the securing element.

14. The dispenser as claimed in claim 13, wherein the securing element is mounted in a rotationally fixed manner on the dispenser.

15. The discharge head as claimed in claim 1, wherein the locking handle is mounted on the securing element for rotation about a longitudinal axis of the discharge head.

* * * * *